US011040533B2

(12) United States Patent
Kobayashi

(10) Patent No.: US 11,040,533 B2
(45) Date of Patent: Jun. 22, 2021

(54) LIQUID EJECTION HEAD AND LIQUID EJECTION APPARATUS

(71) Applicant: SEIKO EPSON CORPORATION, Tokyo (JP)

(72) Inventor: Hiroyuki Kobayashi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/717,604

(22) Filed: Dec. 17, 2019

(65) Prior Publication Data

US 2020/0198347 A1 Jun. 25, 2020

(30) Foreign Application Priority Data

Dec. 20, 2018 (JP) ..... JP2018-238134

(51) Int. Cl.
*B41J 2/14* (2006.01)

(52) U.S. Cl.
CPC ..... *B41J 2/14145* (2013.01); *B41J 2/14201* (2013.01); *B41J 2002/14306* (2013.01)

(58) Field of Classification Search
CPC ..... B41J 2/14145; B41J 2/14201; B41J 2002/14306
See application file for complete search history.

(56) References Cited

U.S. PATENT DOCUMENTS

| | | | | |
|---|---|---|---|---|
| 6,250,753 | B1 | 6/2001 | Nishiwaki et al. | |
| 2002/0051038 | A1 | 5/2002 | Ito et al. | |
| 2006/0017786 | A1 | 1/2006 | Takahashi et al. | |
| 2007/0109373 | A1 | 5/2007 | Kojima et al. | |
| 2008/0204534 | A1 | 8/2008 | Kojima et al. | |
| 2009/0109256 | A1 | 4/2009 | Nagate et al. | |
| 2011/0316943 | A1* | 12/2011 | Owaki | B41J 2/14233 347/85 |
| 2015/0151541 | A1* | 6/2015 | Miyata | B41J 2/14233 347/68 |
| 2015/0202870 | A1* | 7/2015 | Naganuma | B41J 2/14233 347/54 |
| 2018/0250934 | A1 | 9/2018 | Shimoyama et al. | |
| 2018/0264830 | A1* | 9/2018 | Tomimatsu | B41J 2/04581 |
| 2018/0264836 | A1 | 9/2018 | Yamagishi et al. | |

FOREIGN PATENT DOCUMENTS

| | | |
|---|---|---|
| JP | H07246701 | 9/1995 |
| JP | H09314836 | 12/1997 |
| JP | H09314863 | 12/1997 |
| JP | H11309877 | 11/1999 |
| JP | 2002137386 | 5/2002 |
| JP | 2006056242 | 3/2006 |

(Continued)

*Primary Examiner* — Sharon Polk
(74) *Attorney, Agent, or Firm* — Workman Nydegger

(57) ABSTRACT

A liquid ejection head includes: a pressure chamber communicating with a nozzle, the pressure chamber extending along a first axis; a liquid storage chamber that stores liquid which is supplied to the pressure chamber, the liquid storage chamber partially overlapping the pressure chamber when viewed in a direction of a second axis, which intersects the first axis; and a first communication flow path and a second communication flow path extending in a direction of the second axis and allowing the pressure chamber and the liquid storage chamber to communicate with each other.

19 Claims, 7 Drawing Sheets

(56) References Cited

FOREIGN PATENT DOCUMENTS

| | | |
|---|---|---|
| JP | 2007145014 | 6/2007 |
| JP | 2007154014 | 6/2007 |
| JP | 2008149617 | 7/2008 |
| JP | 2008213157 | 9/2008 |
| JP | 2009101643 | 5/2009 |
| JP | 2018144474 | 9/2018 |
| JP | 2018154051 | 10/2018 |

* cited by examiner

LIQUID EJECTION HEAD AND LIQUID EJECTION APPARATUS

The present application is based on, and claims priority from JP Application Serial Number 2018-238134, filed Dec. 20, 2018, the disclosure of which is hereby incorporated by reference herein in its entirety.

BACKGROUND

1. Technical Field

The present disclosure relates to a liquid ejection head and a liquid ejection apparatus.

2. Related Art

Techniques for ejecting liquid in a pressure chamber through nozzles have been proposed. For example, JP-A-2018-154051 discloses a configuration in which a pressure chamber that communicates with a nozzle and a common liquid chamber that stores ink which is supplied to the pressure chamber communicate with each other via a branch flow path.

In order to apply sufficient pressure to liquid in the pressure chamber, the pressure chamber is required to have a sufficient volume. Further, the common liquid chamber is also required to have a sufficient volume. However, increased volume of the pressure chamber and the common liquid chamber causes a problem that the liquid ejection head is increased in size.

SUMMARY

A liquid ejection head according to a preferred embodiment of the disclosure includes: a pressure chamber communicating with a nozzle, the pressure chamber extending along a first axis; a liquid storage chamber that stores liquid which is supplied to the pressure chamber, the liquid storage chamber partially overlapping the pressure chamber when viewed in a direction of a second axis, which intersects the first axis; and a first communication flow path and a second communication flow path extending in a direction of the second axis and allowing the pressure chamber and the liquid storage chamber to communicate with each other.

DESCRIPTION OF EXEMPLARY EMBODIMENTS

First Embodiment

Figure 1:
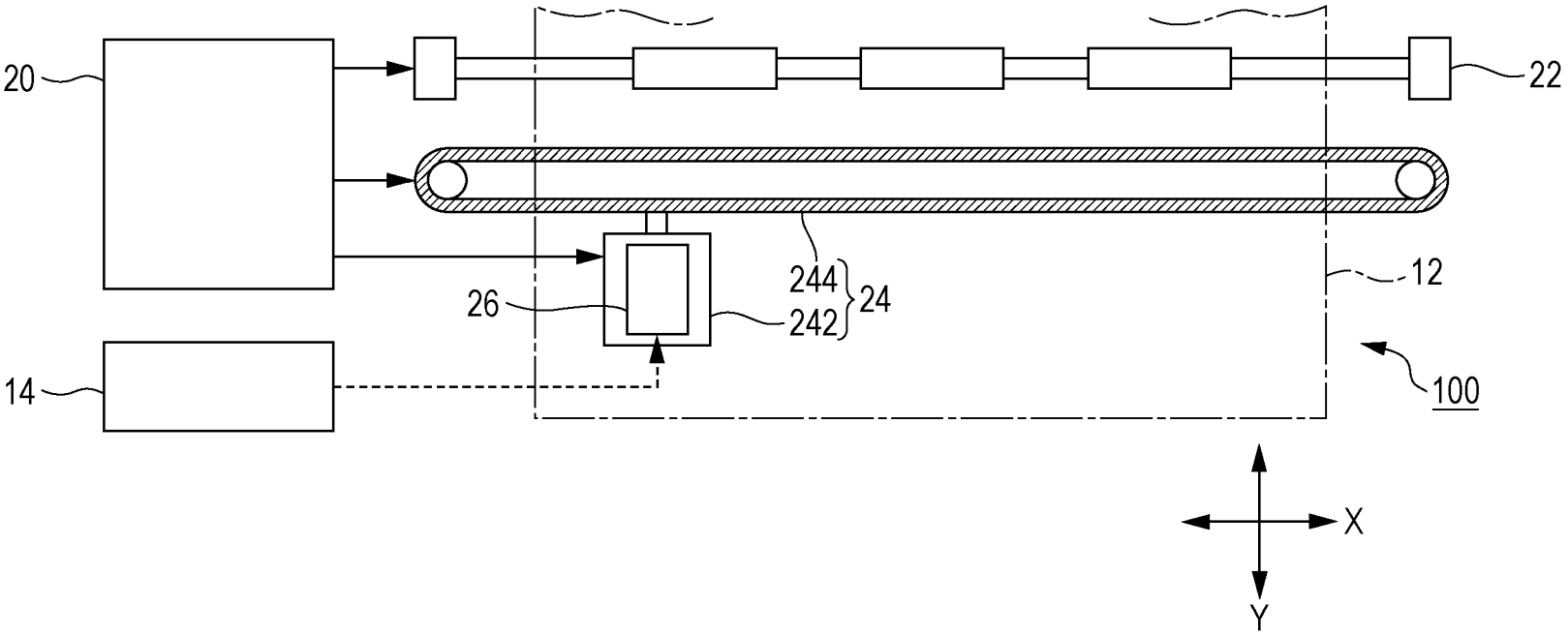
FIG. 1 is a schematic view illustrating a configuration of a liquid ejection apparatus according to a first embodiment.

FIG. 1 is a schematic view illustrating a liquid ejection apparatus 100 according to a first embodiment. The liquid ejection apparatus 100 of the first embodiment is an ink jet recording apparatus that ejects ink, which is an example of liquid, onto a medium 12. The medium 12 is typically a recording paper. However, a recording object made of any material such as a resin film or a fabric may also be used as the medium 12. As illustrated in FIG. 1, the liquid ejection apparatus 100 includes a liquid container 14 that stores ink. Examples of the liquid container 14 include a cartridge detachably attached to the liquid ejection apparatus 100, a bag-shaped ink pack made of a flexible film, and an ink tank that can be refilled with ink.

As illustrated in FIG. 1, the liquid ejection apparatus 100 includes a control unit 20, a transport mechanism 22, a movement mechanism 24, and a liquid ejection head 26. The control unit 20 includes, for example, a processing circuit such as a central processing unit (CPU) or field programmable gate array (FPGA), and a recording circuit such as a semiconductor memory. The control unit 20 integrally controls the components of the liquid ejection apparatus 100. The control unit 20 is an example of a "control section." The transport mechanism 22 transports the medium 12 along a Y axis under the control of the control unit 20.

The movement mechanism 24 reciprocates the liquid ejection head 26 along an X axis under the control of the control unit 20. The X axis intersects the Y axis along which the medium 12 is transported. The X axis is an example of a "first axis." For example, the X axis is perpendicular to the Y axis. The movement mechanism 24 of the first embodiment includes a substantially box-shaped transport body 242 that accommodates the liquid ejection head 26, and a transport belt 244 to which the transport body 242 is fixed. Further, other possible configurations include that in which a plurality of liquid ejection heads 26 are mounted in the transport body 242, and that in which the liquid container 14 together with the liquid ejection head 26 is mounted in the transport body 242.

The liquid ejection head 26 is configured to eject ink, which is supplied from the liquid container 14, onto the medium 12 via a plurality of nozzles under the control of the control unit 20. In parallel with transport of the medium 12 by the transport mechanism 22 and repeated reciprocation of the transport body 242, the respective liquid ejection heads 26 eject ink onto the medium 12 to thereby form an image on a surface of the medium 12.

Figure 2:
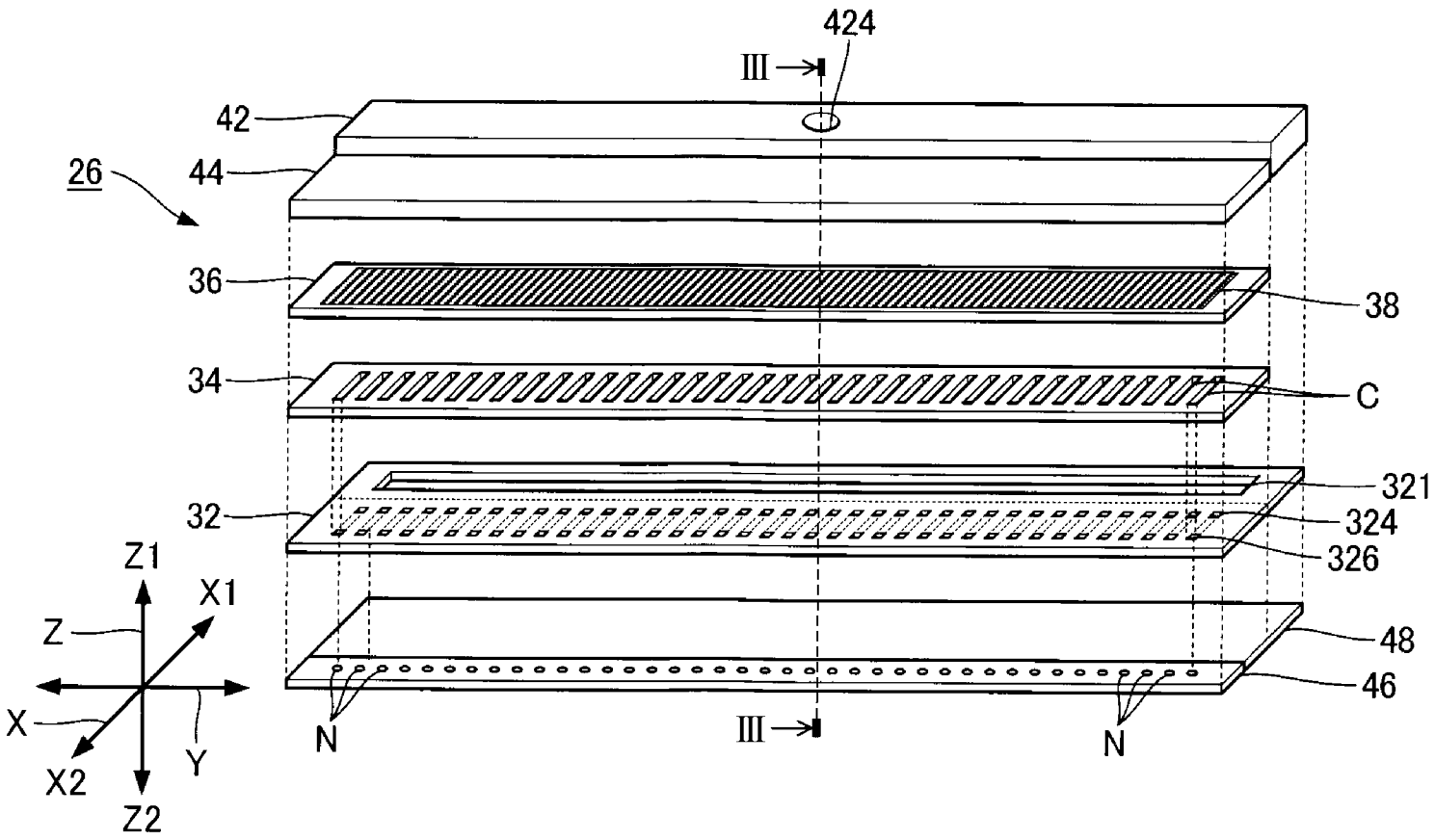
FIG. 2 is an exploded perspective view of a liquid ejection head.
Figure 3:
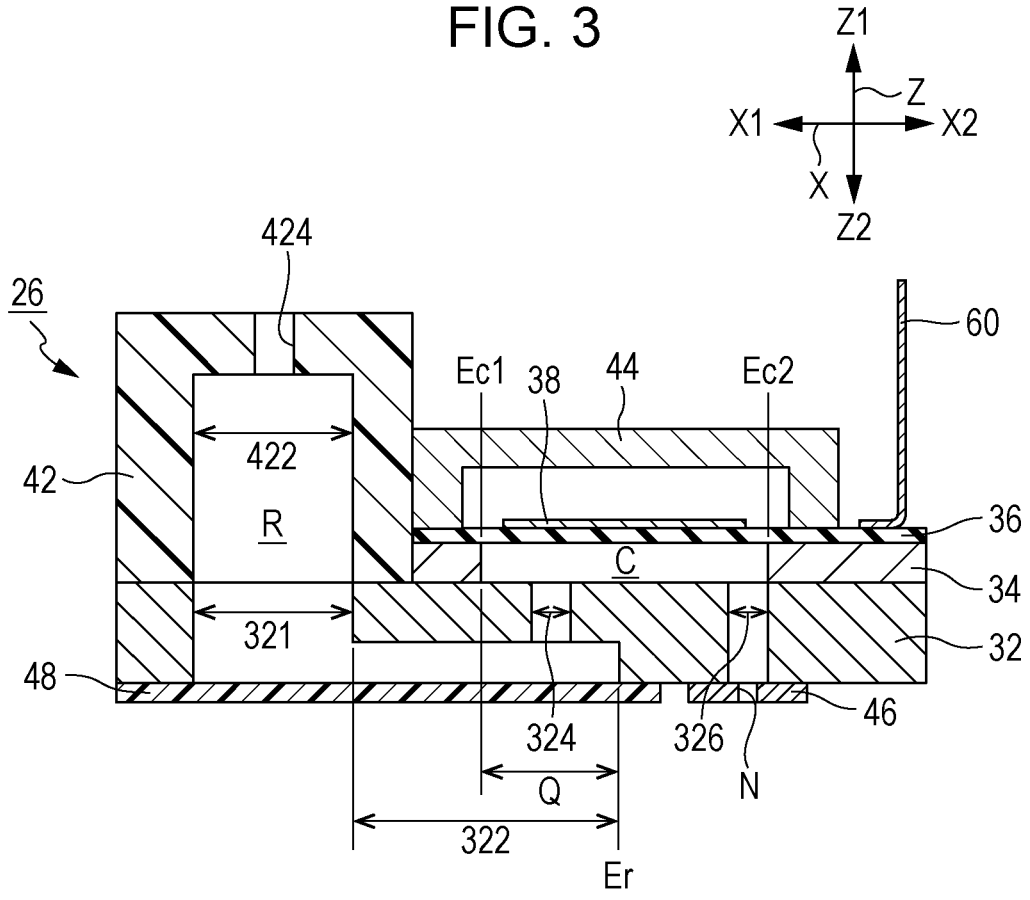
FIG. 3 is a cross-sectional view of the liquid ejection head.

FIG. 2 is an exploded perspective view of the liquid ejection head 26, and FIG. 3 is a cross-sectional view taken along the line III-III of FIG. 2. As illustrated in FIG. 2, a Z axis perpendicular to the X-Y plane is assumed. The cross-section shown in FIG. 3 is parallel with the X-Z plane. The Z axis extends in a direction in which ink is ejected by the liquid ejection head 26. The Z axis is an example of a "second axis." As illustrated in FIG. 2, one side in the Z axis as viewed from an arbitrary point is referred to as a "Z1-side," and the other side is referred to as a "Z2-side." Similarly, one side in the X axis as viewed from an arbitrary point is referred to as an "X1-side," and the other side is referred to as an "X2-side." A direction extending in the X axis may also be referred to as a "first direction," and a direction extending in the Z axis may also be referred to as a "second direction."

As illustrated in FIG. 2, the liquid ejection head 26 includes a flow path substrate 32 having a substantially rectangular shape elongated in the Y axis. The surface of the flow path substrate 32 on the Z1-side is provided with a pressure chamber substrate 34, a vibration plate 36, a plurality of piezoelectric elements 38, a housing 42, and a sealing body 44. The surface of the flow path substrate 32 on the Z2-side is provided with a nozzle plate 46 and a buffer body 48. The respective elements in the liquid ejection head 26 are plate members each having a shape generally elongated in the Y axis as with the flow path substrate 32, and the elements are bonded to each other via an adhesive, for example.

As illustrated in FIG. 2, the nozzle plate 46 is a plate-shaped member in which a plurality of nozzles N are arrayed in the Y axis. The respective nozzles N are through holes through which ink passes. The plurality of nozzles N arrayed in the Y axis is also referred to as a nozzle row. Further, the flow path substrate 32, the pressure chamber substrate 34, and the nozzle plate 46 are formed, for example, by processing a silicon (Si) single crystal substrate by using semiconductor fabrication techniques such as etching. However, materials and fabrication methods of the components of the liquid ejection head 26 are not limited to these described above. The Y axis direction can also be referred to as a direction in which the plurality of nozzles N are arrayed.

The flow path substrate 32 is a plate-shaped member for forming an ink flow path. As illustrated in FIGS. 2 and 3, the flow path substrate 32 includes a first space 321, a second space 322, communication flow paths 324, and ejection flow paths 326. The first space 321 is a through hole that is continuous in the Y axis across the plurality of nozzles N. The second space 322 is a bottomed hole formed on the surface of the flow path substrate 32 on the Z2-side, and is continuous in the Y axis across the plurality of nozzles N. The communication flow paths 324 and the ejection flow paths 326 are through holes individually formed for the respective nozzles N.

The housing 42 is a structure formed, for example, by injection molding of a resin material, and is fixed to the surface of the flow path substrate 32 on the Z1-side. As illustrated in FIG. 3, the housing 42 includes a third space 422 and an introduction port 424. The third space 422 is a bottomed hole having an outer shape corresponding to the first space 321 of the flow path substrate 32. The introduction port 424 is a through hole communicating with the third space 422. As seen from FIG. 3, a space formed by the first space 321 and the second space 322 in the flow path substrate 32 and the third space 422 in the housing 42, which mutually communicate, serves as a liquid storage chamber R. Ink supplied from the liquid container 14 and fed through the introduction port 424 is stored in the liquid storage chamber R.

A buffer body 48 serves to reduce pressure changes in the liquid storage chamber R. The buffer body 48 includes, for example, a flexible sheet member which is elastically deformable. Specifically, the buffer body 48 is disposed on the surface of the flow path substrate 32 on the Z2-side to form the bottom of the liquid storage chamber R, closing the first space 321 and the second space 322 of the flow path substrate 32. That is, the buffer body 48 forms the bottom of a portion of the liquid storage chamber R which is formed by the first space 321 and the second space 322.

Further, the specific configuration for implementing a buffer function for reducing pressure changes in the liquid storage chamber R is not limited to that described above. For example, the buffer body 48 may also be disposed at a position separated from the first space 321 and the second space 322 by some distance. For example, a separate member may also be provided to form the bottom of the portion which is formed by the first space 321 and the second space 322 with the buffer body 48 being disposed to be in contact with a surface of the separate member on a side opposite to that facing the first space 321 and the second space 322.

As illustrated in FIGS. 2 and 3, the pressure chamber substrate 34 is a plate-shaped member in which a plurality of pressure chambers C are formed to respectively correspond to the plurality of nozzles N. The plurality of pressure chambers C are arrayed at intervals in the Y axis. Each pressure chamber C is an opening elongated in the X axis. A portion of the pressure chamber C near an end Ec1 on the X1-side overlaps one communication flow path 324 in plan view. That is, the communication flow path 324 allows the pressure chamber C and the liquid storage chamber R to communicate with each other. Further, a portion of the pressure chamber C near an end Ec2 on the X2-side overlaps one ejection flow path 326 of the flow path substrate 32 in plan view. That is, the ejection flow path 326 allows the pressure chamber C and the nozzle N to communicate with each other.

The vibration plate 36 is disposed on a surface of the pressure chamber substrate 34 on a side opposite to that facing the flow path substrate 32. The vibration plate 36 is an elastically deformable plate member. For example, the vibration plate 36 is a laminate composed of a first layer made of silicon oxide ($SiO_2$) and a second layer made of zirconium oxide ($ZrO_2$).

As seen from FIG. 3, the flow path substrate 32 and the vibration plate 36 face each other with a space therebetween in each pressure chamber C. The pressure chamber C is a space located between the flow path substrate 32 and the vibration plate 36 for imparting a pressure to ink loaded in the pressure chamber C. The vibration plate 36 forms a wall of the pressure chamber C. Ink stored in the liquid storage chamber R is branched from the second space 322 into the respective communication flow paths 324, and then supplied and fed in parallel into the plurality of pressure chambers C. That is, the liquid storage chamber R serves as a common liquid chamber that stores ink to be supplied to the plurality of pressure chambers C.

As illustrated in FIGS. 2 and 3, a plurality of piezoelectric elements 38 are disposed to respectively correspond to the plurality of nozzles N on a surface of the vibration plate 36 on a side opposite to that facing the pressure chamber substrate 34. Each piezoelectric element 38 is a laminate of a first electrode, a piezoelectric layer, and a second electrode, and has a shape elongated in the X axis. The piezoelectric layer is made of a piezoelectric material such as lead zirconate titanate ($Pb(Zr,Ti)O_3$). The plurality of piezoelectric elements 38 are arrayed in the Y axis so as to correspond to the plurality of pressure chambers C. The piezoelectric element 38 is a piezoelectric actuator that deforms in response to supply of a drive signal. When the vibration plate 36 vibrates in connection with deformation of the piezoelectric elements 38, the pressure in the pressure chamber C changes to cause the ink in the pressure chamber C to be ejected though the ejection flow path 326 and the nozzle N. That is, the piezoelectric element 38 is a drive element that causes ink in the pressure chamber C to be ejected through the nozzle N by vibrating the vibration plate 36.

The sealing body 44 shown in FIGS. 2 and 3 is a structure that protects the plurality of piezoelectric elements 38 from the outside air while reinforcing the mechanical strength of the pressure chamber substrate 34 and the vibration plate 36. The sealing body 44 is fixed to a surface of the vibration plate 36, for example, via an adhesive. The plurality of piezoelectric elements 38 are accommodated inside a recess formed on a side of the sealing body 44 that faces the vibration plate 36. Further, as illustrated in FIG. 3, for example, a wiring substrate 60 is connected to the surface of the vibration plate 36. The wiring substrate 60 is a mounted component on which a plurality of wirings (not shown) for electrically connecting the control unit 20 to the liquid ejection head 26 are formed. For example, a flexible wiring substrate 60 such as a flexible printed circuit (FPC) or a flexible flat cable (FFC) is suitably adopted.

Figure 4:
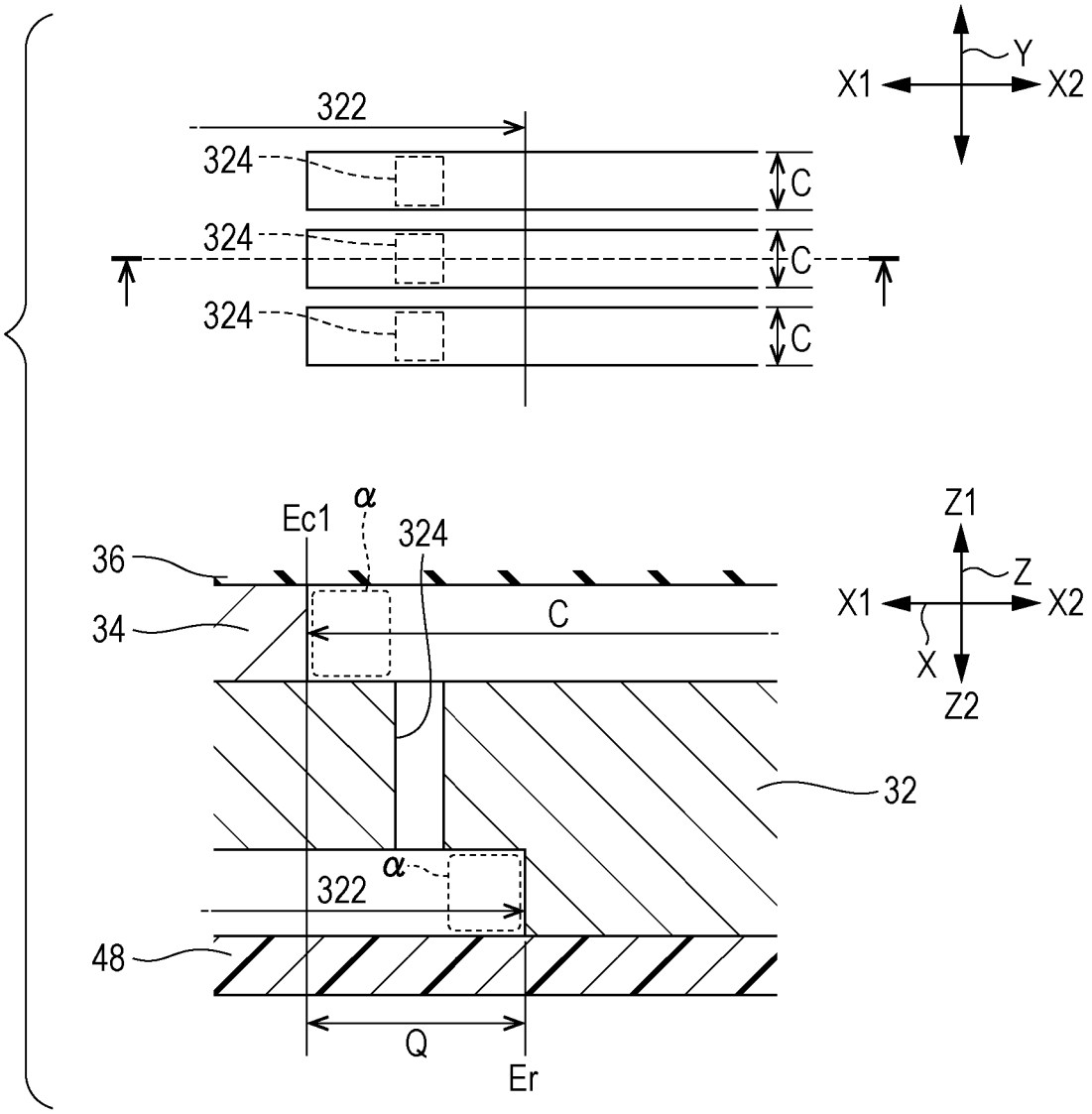
FIG. 4 includes a plan view and a cross-sectional view in which a vicinity of a communication flow path is enlarged.

FIG. 4 includes a plan view and a cross-sectional view in which a vicinity of the communication flow path 324 is enlarged. As illustrated in FIG. 4, the liquid storage chamber R partially overlaps the pressure chamber C in the Z axis direction in plan view. That is, a portion of the pressure chamber C that extends from the end Ec1 on the X1-side toward the X2-side by a predetermined length, which is a range Q, overlaps the liquid storage chamber R in plan view. In the first embodiment, it also overlaps a range of the piezoelectric elements 38 which deforms in response to supply of a drive signal as viewed in the Z direction.

The communication flow path 324, which is formed in the range Q in which the pressure chamber C and the liquid storage chamber R overlap with each other, allows the pressure chamber C and the liquid storage chamber R to communicate with each other. Specifically, the communication flow path 324 is a through hole extending straight in the Z direction from the pressure chamber C to the liquid storage chamber R.

There may be a case where air bubbles are mixed in ink in the liquid ejection head 26. In the first embodiment, as illustrated in FIG. 4, the respective pressure chambers C communicate with the liquid storage chamber R via one communication flow path 324. In the configuration in which the communication flow path 324 is connected to the end Ec1 of the pressure chamber C on the X1-side, air bubbles may be retained in an end Er of the liquid storage chamber R on the X2-side, leading to inhibition of ink flow. On the other hand, in the configuration in which the communication flow path 324 is connected to the end Er of the liquid storage chamber R, air bubbles may be retained in the end Ec1 of the pressure chamber C.

From the viewpoint of reducing the likelihood of retention of air bubbles described above, a configuration is preferred in which the communication flow path 324 is disposed at a substantially center of the range Q in the X axis direction as illustrated in FIG. 4. According to the above configuration, it is possible to reduce the likelihood of air bubbles being distributed to only one of the end Ec1 of the pressure chamber C and the end Er of the liquid storage chamber R. Further, the configuration in which the communication flow path 324 is disposed at a substantially center of the range Q in the X axis direction refers to that, when the end of the range Q on the X1-side is taken as 0% and the end on the X2-side is taken as 100%, the communication flow path 324 is positioned in the range of 30% or more and 70% or less.

Moreover, in the configuration in which the position of the communication flow path 324 in the X axis direction is determined by the above condition, retention of air bubbles is effectively reduced when the range Q in which the pressure chamber C and the liquid storage chamber R overlap with each other is sufficiently small. In order to achieve the above effect, a suitable dimension of the range Q in the X axis direction is, although depending on the specific configuration of the liquid ejection head 26, for example, preferably one-third or less of the dimension of the pressure chamber C in the X axis direction and one-third or less of the dimension of the second space 322 in the X axis direction.

As described above, in the first embodiment, the pressure chamber C and the liquid storage chamber R overlap with each other in the Z axis direction. Accordingly, compared with a configuration in which the pressure chamber C and the liquid storage chamber R do not overlap in the Z axis direction, it is advantageous in that the volume of the liquid storage chamber R can be easily ensured while reducing the size of the liquid ejection head 26 in the X axis direction.

Second Embodiment

The second embodiment will now be described. In the following examples, components having the same function as those of the first embodiment are denoted by the same reference signs as those used in connection with the first embodiment, and the detailed description thereof is omitted as appropriate.

There may be a case where air bubbles are mixed in ink in the liquid ejection head 26. As indicated by the reference sign α in FIG. 4, the air bubble mixed in ink tends to be retained, for example, at the dead end of the flow path. Although retention of air bubbles is moderately reduced when the communication flow path 324 is disposed at the substantially center of the range Q in the X axis direction as described in connection with the first embodiment, some air bubbles may still remain in reality. In view of the above situation, the second embodiment is provided for smooth discharge of air bubbles in the case where air bubbles are generated in the ink in the liquid ejection head 26.

Figure 5:
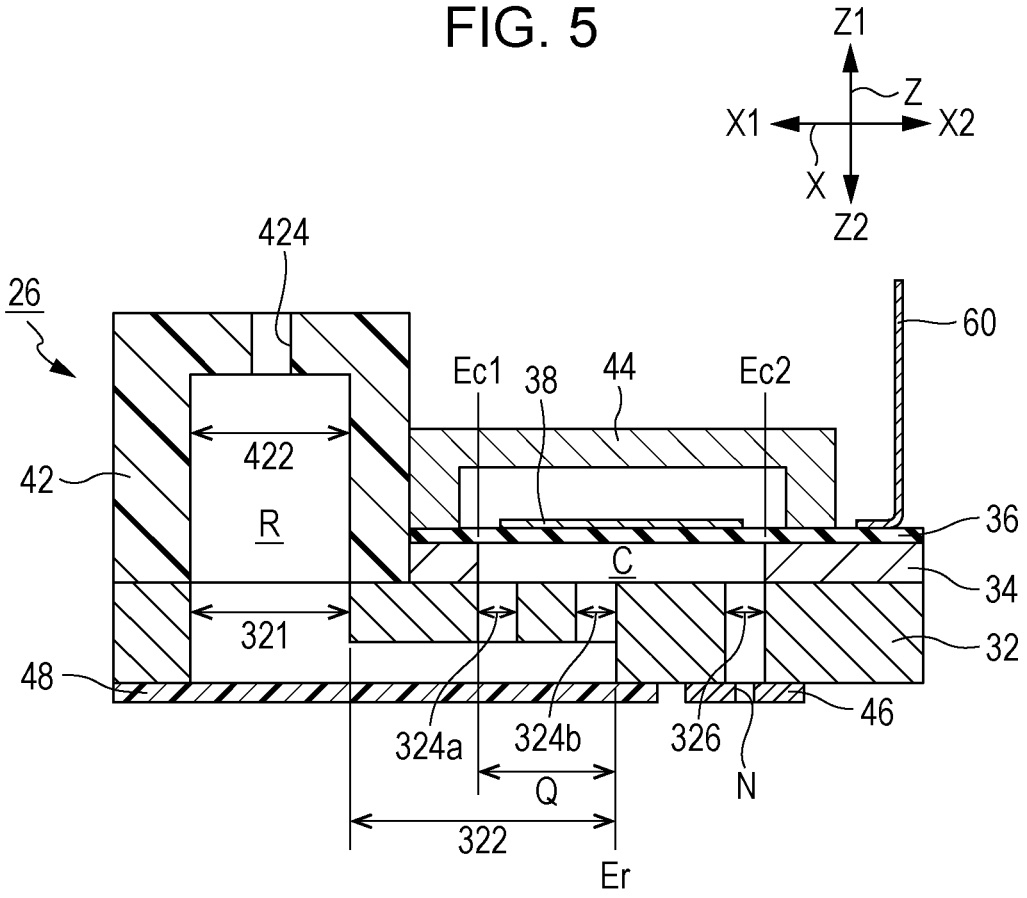
FIG. 5 is a cross-sectional view of the liquid ejection head in a second embodiment.

FIG. 5 is a cross-sectional view of the liquid ejection head 26 in the second embodiment. As illustrated in FIG. 5, the flow path substrate 32 of the second embodiment includes a first communication flow path 324*a* and a second communication flow path 324*b* instead of the communication flow path 324 of the first embodiment.

Figure 6:
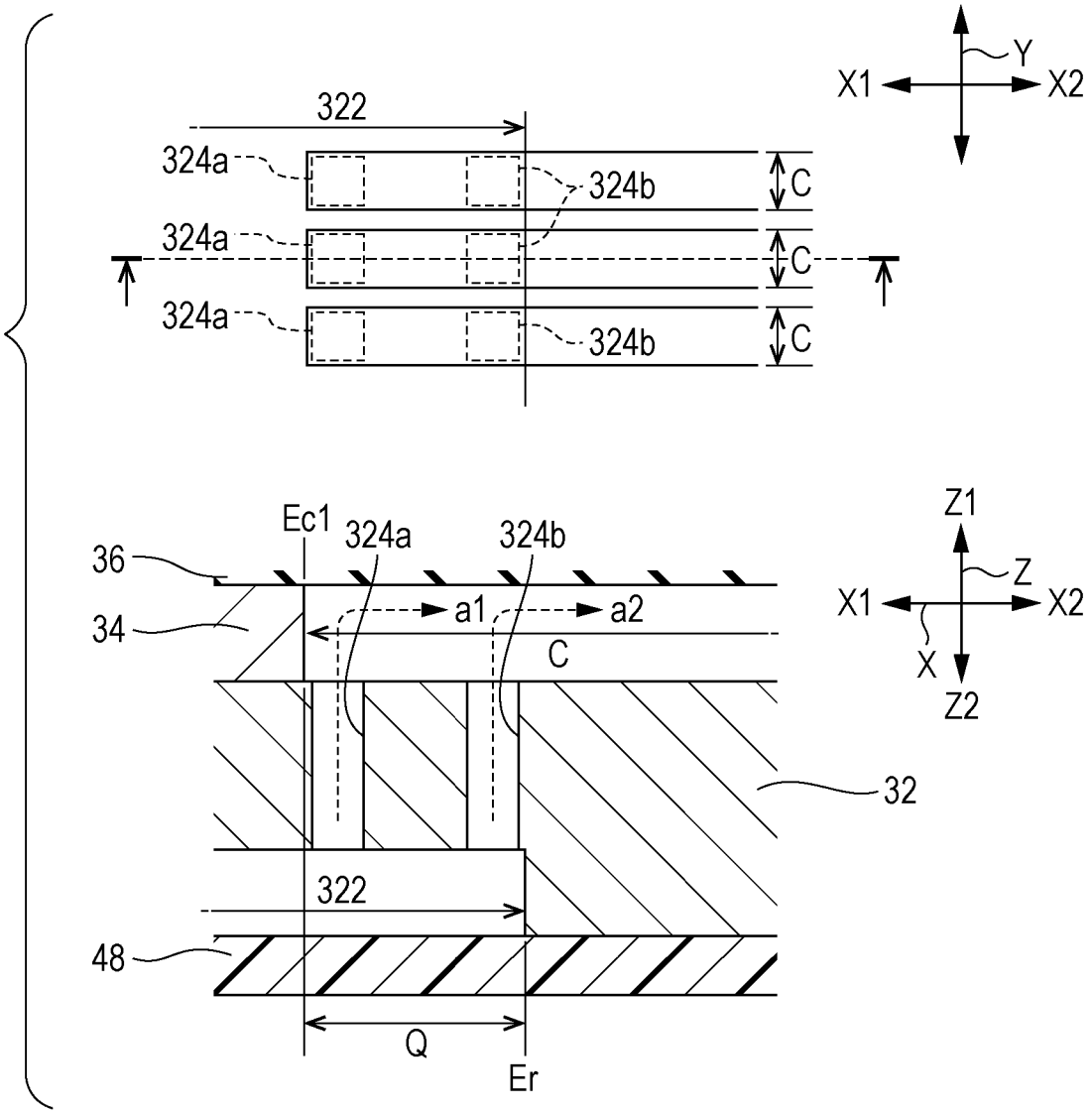
FIG. 6 includes a plan view and a cross-sectional view in which a vicinity of a first communication flow path and a second communication flow path in the second embodiment are enlarged.

FIG. 6 includes a plan view and a cross-sectional view in which a vicinity of the first communication flow path 324*a* and the second communication flow path 324*b* in the second embodiment are enlarged. As illustrated in FIGS. 5 and 6, the first communication flow path 324*a* and the second communication flow path 324*b*, which are formed in the range Q in which the pressure chamber C and the liquid storage chamber R overlap with each other as with the communication flow path 324 of the first embodiment, allows the pressure chamber C and the liquid storage chamber R to communicate with each other. Specifically, the first communication flow path 324*a* and the second communication flow path 324*b* are through holes extending straight in the Z direction from the pressure chamber C to the liquid storage chamber R. As seen from the above description, in the second embodiment, two flow paths are formed to supply ink from the second space 322 to the pressure chamber C via each of the first communication flow path 324*a* and the second communication flow path 324*b*.

As illustrated in FIGS. 5 and 6, the first communication flow path 324*a* and the second communication flow path 324*b* are different in position in the X axis direction. The second communication flow path 324*b* is spaced from the first communication flow path 324*a* by a predetermined distance on the X2-side. Specifically, the first communication flow path 324*a* is connected to the end Ec1 of the pressure chamber C on a side opposite to the end where the nozzle N is located, and to a portion of the liquid storage chamber R which overlaps the end Ec1. The end Ec1 is an end of the pressure chamber C on the X1-side, and is located at an upper end of the first communication flow path 324*a*.

The second communication flow path 324*b* is connected to the end Er of the liquid storage chamber R, which is located on a side closer to the nozzle N, and a portion of the pressure chamber C which overlaps the end Er. The end Er is an end of the liquid storage chamber R on the X2-side, and is located at a lower end of the second communication flow path 324*b*. In plan view in the Z axis direction, the second communication flow path 324*b* is located on the X1-side in the X axis direction as viewed from the midpoint of the pressure chamber C.

As described above, in the second embodiment, since the pressure chamber C and the liquid storage chamber R communicate with each other via the first communication flow path 324*a* and the second communication flow path 324*b*, migration of air bubbles mixed in ink is promoted. For example, an air bubble that has entered the first communication flow path 324*a* travels in the pressure chamber C toward the nozzle N as indicated by the arrow a1 in FIG. 6, and an air bubble that has entered the second communication flow path 324*b* travels in the pressure chamber C toward the nozzle N as indicated by the arrow a2 in FIG. 6. Accordingly, the likelihood of retention of air bubbles in the flow path extending from the liquid storage chamber R to the nozzle N can be reduced. Particularly, in the second embodiment, the first communication flow path 324*a* is connected to the end Ec1 of the pressure chamber C, and the second communication flow path 324*b* is connected to the end Er of the liquid storage chamber R. That is, a dead end is not formed in either the end Ec1 of the pressure chamber C or the end Er of the liquid storage chamber R. Accordingly, it is advantageous in that retention of air bubbles mixed in ink can be effectively reduced.

A combined resistance of a flow path resistance of the first communication flow path 324*a* and a flow path resistance of the second communication flow path 324*b* is larger than a flow path of the nozzle N. According to the above configuration, it is possible to decrease the likelihood of ink flowing backward from the pressure chamber C to the liquid storage chamber R during deformation of the piezoelectric element 38. Therefore, an appropriate amount of ink can be ejected through the nozzle N according to pressure changes in the pressure chamber C.

In addition, a configuration is also preferred in which the combined resistance of the flow path resistance of the first communication flow path 324*a* and the flow path resistance of the second communication flow path 324*b* is smaller than the flow path resistance of the nozzle N. According to the above configuration, the first communication flow path 324*a* or the second communication flow path 324*b* facilitates an easier flow of ink than the nozzle N. Therefore, for example, when ink is continuously ejected, it is possible to reduce the likelihood of shortage of ejection amount of ink due to failure in filling the pressure chamber C with ink in time.

Further, the flow path resistance of the first communication flow path 324*a* is smaller than the flow path resistance of the second communication flow path 324*b*. For example, a cross-sectional area of the flow path of the first communication flow path 324*a* is larger than a cross-sectional area of the flow path of the second communication flow path 324*b*. According to the above configuration, the first communication flow path 324*a* can be preferentially used to supply ink from the liquid storage chamber R to the pressure chamber C. In other words, the first communication flow path 324*a* is preferentially used to supply ink to the pressure chamber C, whereas the second communication flow path 324*b* is preferentially used to discharge air bubbles.

Third Embodiment

Figure 7:
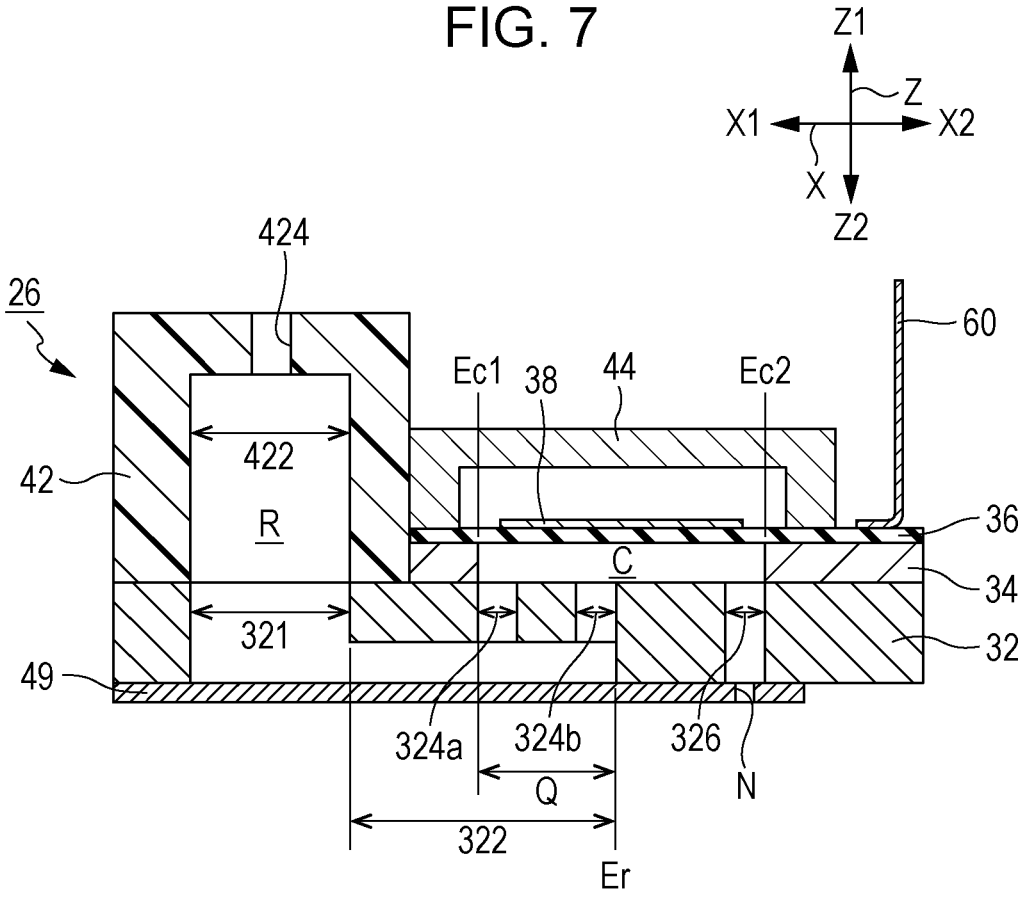
FIG. 7 is a cross-sectional view of the liquid ejection head in a third embodiment.

FIG. 7 is a cross-sectional view of a configuration of the liquid ejection head 26 according to the third embodiment. As illustrated in FIG. 7, the liquid ejection head 26 of the third embodiment has a configuration in which the nozzle plate 46 and the buffer body 48 of the second embodiment are replaced with a plate member 49. The plate member 49 is a flat plate member that covers the entire surface of the flow path substrate 32 on the Z2-side.

A plurality of nozzles N are formed in the plate member 49. That is, the plate member 49 serves as the nozzle plate 46 of the first embodiment. Further, the plate member 49 closes the first space 321 and the second space 322 of the flow path substrate 32, and elastically deforms according to the pressure changes in the liquid storage chamber R to thereby reduce the pressure changes. That is, the plate member 49 also serves as the buffer body 48 of the first embodiment. As seen from the above description, the nozzle plate 46 and the buffer body 48 of the first embodiment are integrated as the plate member 49 in the third embodiment. The plurality of nozzles N are through holes formed in the plate member 49, which also serves as the buffer body 48.

According to the third embodiment, the liquid ejection head 26 has a simplified configuration over the first embodiment in which the nozzle plate 46 and the buffer body 48 are separately provided. Moreover, it is also advantageous in that the likelihood of ink or moisture entering a gap between the nozzle plate 46 and the buffer body 48 can be reduced. Further, although FIG. 7 shows the example in which the first communication flow path 324*a* and the second communication flow path 324*b* are formed in the flow path substrate 32, the configuration having the plate member 49 can also be applied to the configuration of the first embodiment in which the pressure chamber C and the liquid storage chamber R communicate with each other via a single communication flow path 324.

Modified Examples

The aforementioned embodiments can be modified in various ways. Specific modifications that can be applied to the aforementioned embodiments will be exemplified below. Further, any two or more of modifications selected from the following examples can be combined as appropriate to the extent that they do not contradict each other.

(1) In the first embodiment and the second embodiment, both the nozzle plate 46 and the buffer body 48 are disposed on the flow path substrate 32. However, either or both of the nozzle plate 46 and the buffer body 48 may be formed integrally with the flow path substrate 32. The plate member 49 of the third embodiment may also be formed integrally with the flow path substrate 32.

(2) In the second embodiment, the first communication flow path 324*a* and the second communication flow path 324*b* are spaced in the X axis direction. However, the positional relationship between the first communication flow path 324*a* and the second communication flow path 324*b* is not limited to the above example. For example, the first communication flow path 324*a* and the second communication flow path 324*b* may also be arranged in the Y direction. Furthermore, a configuration in which the first communication flow path 324*a* is formed at a position spaced from the end Ec1 of the pressure chamber C, or a configuration in which the second communication flow path 324*b* is formed at a position spaced from the end Er of the liquid storage chamber R can also be assumed.

(3) The shape or direction of the first communication flow path 324*a* and the second communication flow path 324*b* is not limited those described in the second embodiment. For example, either or both of the first communication flow path 324*a* and the second communication flow path 324*b* may be curved. However, ink flow is more likely to be inhibited in a curved flow path compared with a straight flow path. Therefore, one of the first communication flow path 324*a* and the second communication flow path 324*b* is preferably formed in a straight shape to ensure smooth flow of ink. A configuration in which the first communication flow path 324*a* and the second communication flow path 324*b* extend in a direction inclined relative to the Z axis is also adopted. Further, in the second embodiment, the number of communication flow paths that allow the pressure chamber C and the liquid storage chamber R to communicate with each other is not limited to two. The pressure chamber C and the liquid storage chamber R may also communicate with each other via three or more communication flow paths.

(4) The drive element that causes ink in the pressure chamber C to be ejected through the nozzle N is not limited to the piezoelectric element 38 described in the aforementioned embodiments. For example, a heat generating element that uses heat to generate air bubbles in the pressure chamber C to thereby change the pressure can also be used as the drive element. As seen from the above examples, the drive element is comprehensively described as an element that causes ink in the pressure chamber C to be ejected through the nozzle N, and an operation method such as a piezoelectric method or a thermal method and a specific configuration of the drive element are not specifically limited.

(5) While the aforementioned embodiments illustrate a serial-type liquid ejection apparatus 100 configured to reciprocate the transport body 242 on which the liquid ejection head 26 is mounted, the transport body 242 may also be configured to move only in one direction. Further, the disclosure can also be applied to a line-type liquid ejection apparatus in which the plurality of nozzles N are distributed over the entire width of the medium 12.

(6) The liquid ejection apparatus 100 illustrated in the aforementioned embodiments can be used in various apparatuses such as facsimile machines and copying machines in addition to the apparatuses dedicated to printing. The applications of the liquid ejection apparatus of the disclosure are not limited to printing. For example, a liquid ejection apparatus configured to eject a solution of a color material is used as a manufacturing apparatus for forming color filters of liquid crystal displays. Further, a liquid ejection apparatus configured to eject a solution of a conductive material is used as a manufacturing apparatus for forming wirings and electrodes of wiring substrates. A liquid ejection apparatus configured to eject biomolecules such as cells is used as an apparatus for manufacturing biochips in which biomolecules are fixed to a substrate.

What is claimed is:

1. A liquid ejection head comprising:

a pressure chamber communicating with a nozzle, the pressure chamber extending along a first axis;

a liquid storage chamber that stores liquid which is supplied to the pressure chamber, the liquid storage chamber partially overlapping the pressure chamber when viewed in a direction of a second axis, which intersects the first axis;

a first communication flow path extending in a direction of the second axis and communicating the pressure chamber with the liquid storage chamber; and a second communication flow path extending in a direction of the second axis and communicating the pressure chamber with the liquid storage chamber, wherein the first communication flow path and the second communication flow path are separated from each other.

2. The liquid ejection head according to claim 1, wherein the first communication flow path and the second communication flow path are shifted from each other in a direction of the first axis.

3. The liquid ejection head according to claim 2, wherein the first communication flow path is connected to an end of the pressure chamber in a direction of the first axis, and the second communication flow path is connected to an end of the liquid storage chamber in a direction of the first axis.

4. The liquid ejection head according to claim 1, wherein a combined resistance of a flow path resistance of the first communication flow path and a flow path resistance of the second communication flow path is larger than a flow path resistance of the nozzle.

5. The liquid ejection head according to claim 1, wherein a combined resistance of a flow path resistance of the first communication flow path and a flow path resistance of the second communication flow path is smaller than a flow path resistance of the nozzle.

6. The liquid ejection head according to claim 1, wherein a flow path resistance of the first communication flow path is smaller than a flow path resistance of the second communication flow path.

7. The liquid ejection head according to claim 1, wherein the liquid storage chamber is partially formed of a buffer body configured to elastically deform according to pressure change in the liquid storage chamber.

8. The liquid ejection head according to claim 7, wherein the buffer body is a plate-shaped member, and the nozzle is a through hole formed in the buffer body.

9. A liquid ejection apparatus comprising:

the liquid ejection head according to claim 1; and a control section that controls the liquid ejection head.

10. The liquid ejection head according to claim 1, wherein the first communication flow path and the second communication flow path are shifted from each other in a direction of a third axis, which intersects the first axis and the second axis.

11. The liquid ejection head according to claim 1, wherein the first communication flow path and the second communication flow path extend through a single flow path substrate that separates the liquid storage chamber and the pressure chamber.

12. A liquid ejection head comprising:

a pressure chamber communicating with a nozzle, the pressure chamber extending along a first axis;

a liquid storage chamber that stores liquid which is supplied to the pressure chamber, the liquid storage chamber partially overlapping the pressure chamber when viewed in a direction of a second axis, which intersects the first axis;

a first communication flow path extending in a direction of the second axis and communicating the pressure chamber with the liquid storage chamber; and a second communication flow path extending in a direction of the second axis and communicating the pressure chamber with the liquid storage chamber, wherein a combined resistance of a flow path resistance of the first communication flow path and a flow path resistance of the second communication flow path is larger than a flow path resistance of the nozzle.

13. A liquid ejection apparatus comprising:

the liquid ejection head according to claim 12; and a control section that controls the liquid ejection head.

14. A liquid ejection head comprising:

a pressure chamber communicating with a nozzle, the pressure chamber extending along a first axis;

a liquid storage chamber that stores liquid which is supplied to the pressure chamber, the liquid storage chamber partially overlapping the pressure chamber when viewed in a direction of a second axis, which intersects the first axis;

a first communication flow path extending in a direction of the second axis and communicating the pressure chamber with the liquid storage chamber; and a second communication flow path extending in a direction of the second axis and communicating the pressure chamber with the liquid storage chamber, wherein a combined resistance of a flow path resistance of the first communication flow path and a flow path resistance of the second communication flow path is smaller than a flow path resistance of the nozzle.

15. A liquid ejection apparatus comprising:

the liquid ejection head according to claim 14; and a control section that controls the liquid ejection head.

16. A liquid ejection head comprising:

a pressure chamber communicating with a nozzle, the pressure chamber extending along a first axis;

a liquid storage chamber that stores liquid which is supplied to the pressure chamber, the liquid storage chamber partially overlapping the pressure chamber when viewed in a direction of a second axis, which intersects the first axis;

a first communication flow path extending in a direction of the second axis and communicating the pressure chamber with the liquid storage chamber; and a second communication flow path extending in a direction of the second axis and communicating the pressure chamber with the liquid storage chamber wherein a flow path resistance of the first communication flow path is smaller than a flow path resistance of the second communication flow path.

17. A liquid ejection apparatus comprising:

the liquid ejection head according to claim 16; and a control section that controls the liquid ejection head.

18. A liquid ejection head comprising:

a pressure chamber communicating with a nozzle, the pressure chamber extending along a first axis;

a liquid storage chamber that stores liquid which is supplied to the pressure chamber, the liquid storage chamber partially overlapping the pressure chamber when viewed in a direction of a second axis, which intersects the first axis;

a first communication flow path extending in a direction of the second axis and communicating the pressure chamber with the liquid storage chamber; and a second communication flow path extending in a direction of the second axis and communicating the pressure chamber with the liquid storage chamber, wherein the liquid storage chamber is partially formed of a buffer body configured to elastically deform according to pressure change in the liquid storage chamber.

19. A liquid ejection apparatus comprising:

the liquid ejection head according to claim 18; and a control section that controls the liquid ejection head.

* * * * *